US009386363B2

(12) United States Patent
Sim et al.

(10) Patent No.: US 9,386,363 B2
(45) Date of Patent: Jul. 5, 2016

(54) SPEAKER APPARATUS SUITABLE FOR USE WITH A COMPUTER

(71) Applicant: Creative Technology Ltd, Singapore (SG)

(72) Inventors: Wong Hoo Sim, Singapore (SG); Long Chye Low, Singapore (SG); Jiunn Shyong Neo, Singapore (SG); Thean Kuie Christopher Chang, Singapore (SG); Kok Huan Ong, Singapore (SG)

(73) Assignee: Creative Technology Ltd, Singapore (SG)

( * ) Notice: Subject to any disclaimer, the term of this patent is extended or adjusted under 35 U.S.C. 154(b) by 87 days.

(21) Appl. No.: 14/360,562

(22) PCT Filed: Oct. 22, 2012

(86) PCT No.: PCT/SG2012/000398

§ 371 (c)(1),
(2) Date: May 23, 2014

(87) PCT Pub. No.: WO2013/077807

PCT Pub. Date: May 30, 2013

(65) Prior Publication Data

US 2014/0341410 A1 Nov. 20, 2014

(30) Foreign Application Priority Data

Nov. 25, 2011 (SG) ..... 201108766

(51) Int. Cl.

| | |
|---|---|
| ***H04R 1/02*** | (2006.01) |
| ***H04R 5/02*** | (2006.01) |
| *G10L 21/0208* | (2013.01) |

(52) U.S. Cl.

CPC ..... *H04R 1/028* (2013.01); *H04R 5/02* (2013.01); *G10L 21/0208* (2013.01); *H04R 2205/022* (2013.01)

(58) Field of Classification Search

CPC ..... H04R 5/02; H04R 1/025; H04R 1/02; H04R 1/026; H04R 2499/11; H04R 2205/021

USPC ..... 381/332

See application file for complete search history.

(56) References Cited

U.S. PATENT DOCUMENTS

| | | | | |
|---|---|---|---|---|
| 6,043,976 | A * | 3/2000 | Su | G06F 1/1632 361/679.41 |
| 8,126,180 | B2 * | 2/2012 | Jacob | H04R 1/26 381/332 |
| 9,002,050 | B2 * | 4/2015 | Widner | H04R 5/02 381/300 |
| 2002/0146140 | A1 * | 10/2002 | Chiu | H04R 1/02 381/332 |
| 2003/0063765 | A1 * | 4/2003 | Lu | G06F 1/1605 381/333 |
| 2009/0180660 | A1 * | 7/2009 | Groset | H04R 5/02 381/386 |

(Continued)

*Primary Examiner* — Mark Blouin

(74) *Attorney, Agent, or Firm* — Russell Swerdon; Desmund Gean

(57) ABSTRACT

A speaker apparatus suitable for use with a computer operable for communicating audio signals to the speaker apparatus. The speaker apparatus includes a housing having a top portion and a body portion adjacent the top portion. The housing can be configured for carrying a coupling module and a speaker driver array. The coupling module can be configured for coupling the speaker apparatus and the computer. The speaker driver array can include a first speaker driver and a second speaker driver. The first and second speaker drivers can be arranged in a stacked arrangement. The stacked arrangement can be such that the first speaker driver can be positioned atop the second speaker and such that the first and second speaker drivers face different directions.

13 Claims, 3 Drawing Sheets

(56) References Cited

U.S. PATENT DOCUMENTS

2010/0111342 A1 5/2010 Jacob et al.
2011/0235847 A1* 9/2011 Bhutani ..... H04R 5/02 381/395
2013/0083953 A1* 4/2013 Chang ..... G06F 1/1628 381/333
2013/0142371 A1* 6/2013 Martin ..... H04R 1/025 381/333

* cited by examiner

SPEAKER APPARATUS SUITABLE FOR USE WITH A COMPUTER

FIELD OF INVENTION

The present disclosure generally relates to speaker drivers suitable for output of audio signals. More particularly, various embodiments of the disclosure relate to a speaker apparatus suitable for use with a computer in a manner so as to process and output audio signals communicable from the computer.

BACKGROUND

Computers are generally used by a user for data processing as well as for entertainment purposes. Particularly, computers can be used for processing audio files such as MP3/MP4 files, AAC files and/or WAV files. Audio files can be processed in a manner such that audio signals, such as music, can be output for the audio entertainment of a user using the computer. Particularly, audio signals can be output in a manner such that the audio signals can be audibly perceived by a user of the computer.

Audio signals can be stereo based audio signals. Specifically, the audio signals can include left channel audio signals and right channel audio signals. The left and right channel audio signals are typically suitable for audio perception by the left ear and right ear, respectively, of a user.

Conventional techniques to output audio signals include equipping computers with speakers. Particularly, a left channel speaker and a right channel speaker are typically provided and cable connected to the computer.

More particularly, a left channel speaker is connected to the left side of the computer and a right channel speaker is connected to the right side of the computer. The left and right channel speakers can be configured to output the left and right channel audio signals respectively. In this manner, a user facing the computer can enjoy the stereo effect of the audio signals.

Unfortunately, conventional techniques to output audio signals may not be capable of facilitating the output of audio signals in a suitably efficient manner.

For example, for a user of the computer to enjoy the stereo effect of the audio signals, a speaker has to be placed at each side of the computer. As such, space to place speakers on either side of the computer must be available.

Moreover, as speakers are typically cable connected to the computer. It is appreciable that cable tangle around the computer would also be a considerable issue.

It is therefore desirable to provide a solution to address at least one of the foregoing problems of conventional techniques.

SUMMARY OF THE INVENTION

In accordance with an aspect of the disclosure, a speaker apparatus is provided. Preferably, the speaker apparatus is suitable for use with a computer having a screen. The computer can be operated for communicating audio signals to the speaker apparatus.

The speaker apparatus can include a housing. The housing can include a top portion and a body portion. The top portion can be adjacent to the body portion.

The housing can be configured to carry a coupling module and a speaker driver array. The housing can be configured to further carry a processing module. The coupling module and the speaker driver array can be coupled to the processing module.

The coupling module can be configured to couple the speaker apparatus and the computer. For example, the coupling module can be configured to coupled the speaker apparatus and the computer in a manner such that audio signals can be communicated from the computer to the speaker apparatus for processing.

The processing module can be coupled to the coupling module in a manner so as to receive the audio signals. The processing module can be configured to process the audio signals in a manner so as to produce output signals.

The speaker driver array can be coupled to the processing module in a manner so as to receive the output signals. The output signals can be output by the speaker driver array.

The speaker driver array can include a first speaker driver and a second speaker driver. The first and second speaker drivers can be arranged in a stacked arrangement such that the first speaker driver can be positioned atop the second speaker diver and such that the first and second speaker drivers face different directions. The speaker driver array can, for example, be accommodated at the top portion of the housing.

Preferably, the speaker apparatus can be positioned behind the computer in a manner such that the body portion of the housing is substantially hidden by the screen of the computer and the top portion of the housing is substantially elevated over the screen of the computer.

Additionally, the housing can be further configured for carrying a sound detection array. The sound detection array can be coupled to the processing module. The sound detection array can be configured for detecting audio inputs within a region adjacent thereto.

Furthermore the housing can be further configured for carrying a peripheral portion. The peripheral portion can be coupled to the processing module. The peripheral portion can be configured for receiving a peripheral device. The peripheral device can be capable of facilitating signal communication between an auxiliary device and the speaker apparatus.

Yet furthermore, the speaker apparatus can further include a base portion to which the housing can be detachably coupled. Preferably, the housing is rotatable on the base portion.

BRIEF DESCRIPTION OF THE DRAWINGS

Embodiments of the disclosure are described hereinafter with reference to the following drawings, in which.

DETAILED DESCRIPTION

Representative embodiments of the disclosure, for addressing one or more of the foregoing problems associated with conventional techniques, are described hereinafter with reference to FIG. 1 to FIG. 3.

Figure 1B:
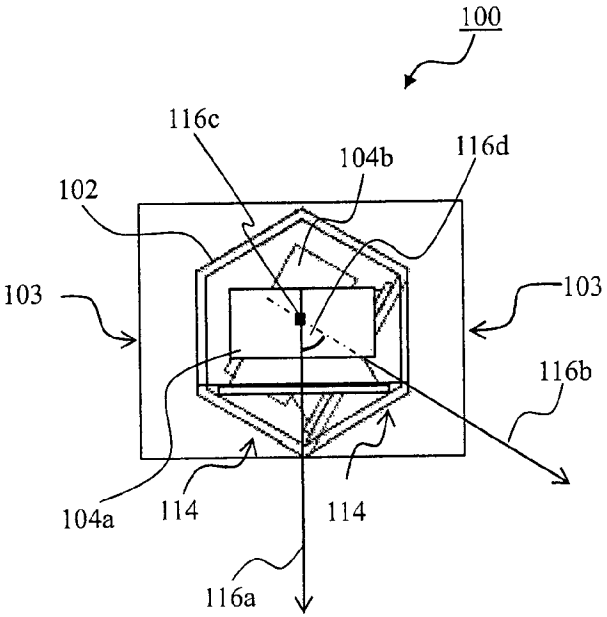
FIG. 1*b* shows a top view of the speaker apparatus of FIG. 1*a*, according to an embodiment of the disclosure.
Figure 1A:
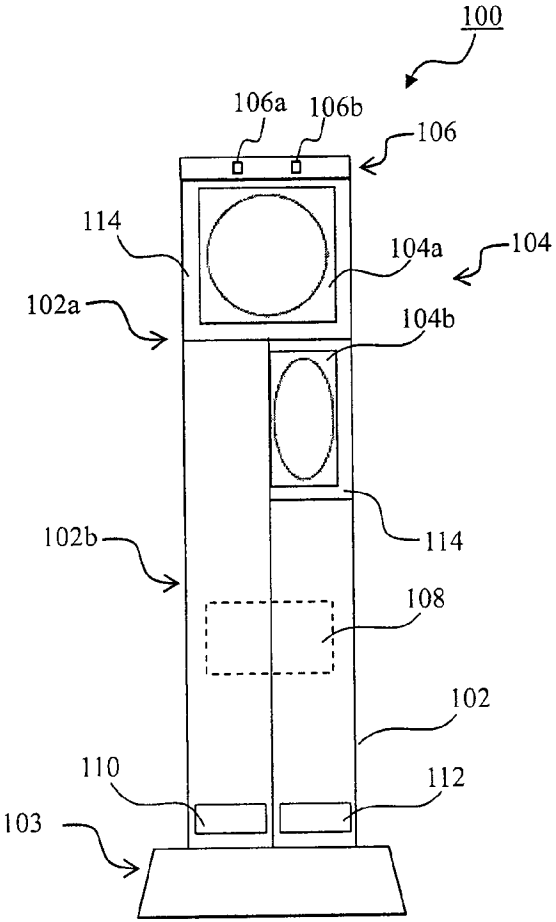
FIG. 1*a* shows a front view of a speaker apparatus which includes a housing configurable for carrying a speaker driver array, a sound detection array, the processing module, a coupling module and a peripheral portion, according to an embodiment of the disclosure.
Figure 2:
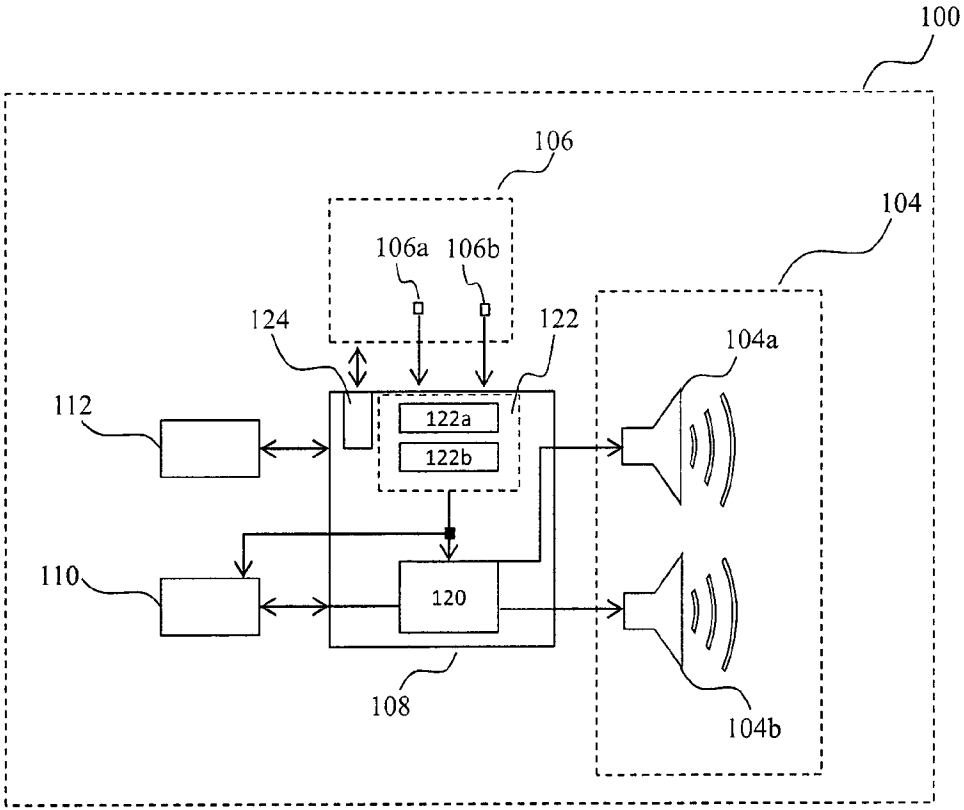
FIG. 2 shows, in further detail, the processing module of the speaker apparatus of FIG. 1*a* which can be coupled to the speaker driver array, the sound detection array, the coupling module and the peripheral portion, according to an embodiment of the disclosure.

A speaker apparatus 100, according to an embodiment of the disclosure, is shown in FIG. 1*a* and FIG. 1*b*. FIG. 1*a* provides a front view of the speaker apparatus 100. FIG. 1*b* provides a top view of the speaker apparatus 100.

Referring to FIG. 1*a*, the speaker apparatus 100 can include a housing 102 and optionally, a base portion 103. The housing 102 can, for example, be a chassis.

The speaker apparatus 100 can further include a speaker driver array 104, a sound detection array 106, a processing module 108 and a coupling module 110. The speaker apparatus 100 can, optionally, include a peripheral portion 112.

The housing 102 can be coupled to the base portion 103. Preferably, the housing 102 can be detachably coupled to the base portion 103. Additionally, the housing 102 can further be coupled to the base portion 103 such that housing 102 is rotatable on the base portion 103.

Furthermore, the housing 102 can include a top portion 102*a* and a body portion 102*b*. As shown, the top portion 102*a* is adjacent the body portion 102*b*. Furthermore, when the housing 102 is coupled to the base portion 103, the body portion 102*b* is between the top and base portions 102*a*/103.

As shown, the housing 102 can be configured to carry the speaker driver array 104, the sound detection array 106, the processing module 108, the coupling module 110 and the peripheral portion 112.

In one exemplary configuration, the housing 102 can be configured such that the speaker driver array 104 and the sound detection array 106 can be accommodated at the top portion 102*a*. The housing 102 can be further configured such that the processing module 108, the coupling module 110 and the peripheral portion 112 can be accommodated at the body portion 102*b*. Furthermore, the processing module 108 can be accommodated within the housing 102. The speaker driver array 104, sound detection array 106, coupling module 110 and the peripheral portion 112 can be coupled to the processing module 108 as will be discussed later with reference to FIG. 2.

Based on the above exemplary configuration, the housing 102 can be further configured such that one or more openings 114 can be provided as outlets for the speaker driver array 104. Preferably, a grill cloth (not shown) can be disposed over the speaker apparatus 100 in a manner so as to cover the aforementioned one or more openings 114. Alternatively, one or more detachable grilles (not shown) can be provided for covering the aforementioned one or more openings 114.

The speaker driver array 104 can include a plurality of speaker drivers. Specifically, the speaker driver array 104 can, for example, include a first speaker driver 104*a* and a second speaker driver 104*b*. The first and second speaker drivers 104*a*/104*b* can be in a stacked arrangement such that the first speaker driver 104*a* is, for example, atop the second speaker driver 104*b*. Additionally, the speaker drivers of the speaker driver array 104 can be angularly positioned/arranged such that one speaker driver can be considered to be angularly displaced with respect to another speaker driver.

In one example, the second speaker driver 104*b* can be angularly positioned with reference to the first speaker driver 104*a* such that the second speaker driver 104*b* is angularly displaced relative to the first speaker driver 104*a*. In another example, the first speaker driver 104*a* can be angularly positioned with reference to the second speaker driver 104*b* such that the first speaker 104*a* is angularly displaced relative to the second speaker 104*b*.

More specifically, the first and second speaker drivers 104*a*/104*b* can be positioned such that they face different directions. The speaker driver array 104, in particular the positioning of the first and second speaker drivers 104*a*/104*b*, will be discussed in further detail with reference to FIG. 1*b*.

The sound detection array 106 can include a plurality of sound detection devices. Specifically, the sound detection array 106 can, for example, include a first sound detection device 106*a* and a second sound detection device 106*b*. An example of a sound detection device is a microphone. The first and second sound detection devices 106*a*/106*b* can be spaced apart and positioned atop the speaker driver array 104. The first and second sound detection devices 106*a*/106*b* can, for example, be spaced approximately 3.5 cm apart.

Additionally, the sound detection array 106 can be configured to detect audio inputs such as voice inputs. The detected audio inputs can be processed by the speaker apparatus 100 in a manner as will be discussed in further detail with reference to FIG. 2.

The coupling module 110 can be configured to facilitate one or both of wireless coupling and wired coupling of the speaker apparatus 100 to a first device as will be discussed in further detail with reference to FIG. 3.

In one embodiment, the coupling module 110 can include a wire based connection port such as a Universal Serial Bus (USB) port. In this regard, the speaker apparatus 100 can, via the coupling module 110, be coupled to the first device via a USB connection. In another embodiment, the coupling module 110 can include a transceiver suitable for wireless communication. In this regard, the speaker apparatus 100 can be wirelessly coupled, via the coupling module 110, to the first device.

When coupled, the speaker apparatus 100 and the first device can be configured to signal communicate with each other. Specifically, the first device can be operated to communicate audio signals to the speaker apparatus 100 for processing. The first device can have a left output audio channel and a right output audio channel. In this regard, audio signals communicated from the first device can, for example, include left channel audio signals and right channel audio signals in association with the left output audio channel and the right output audio channel respectively.

Audio signals communicated from the first device can be received and processed by the speaker apparatus 100 in a manner as will be discussed in further detail with reference to FIG. 2.

The peripheral portion 112 can be an adapter portion which can be configured to receive and couple a peripheral device to the processing portion 108. Examples of the peripheral device include a dongle, a wireless adapter, a Bluetooth based transceiver, a PC/PCMCIA card or a general peripheral component interconnect (PCI) card. In this regard, the peripheral portion 112 can, for example, be in the form of a slot dimensioned to receive and accommodate a peripheral device.

Appreciably, the peripheral portion 112 is capable of facilitating signal communication between the speaker apparatus 100 and a second device. The second device can be an auxiliary device relative to the first device. Examples of an auxiliary device include a wireless headset, a mobile phone device and a portable media player device.

Referring to FIG. 1*b*, when arranged in a stacked arrangement where, for example, the first speaker driver 104*a* is positioned atop the second speaker driver 104*b*, and the first and second speaker drivers 104*a*/104*b* face different directions, the first and second speaker drivers 104*a*/104*b* can be associated with a first firing direction 116*a* and a second firing direction 116*b* respectively.

The first firing direction 116*a* can be indicative of a general direction of sound/audio emission from the first speaker driver 104*a*. As shown, the first firing direction 116*a* can be substantially incident to the first speaker driver 104*a*. The second firing direction 116*b* can be indicative of a general direction of sound/audio emission from the second speaker driver 104*b*. As shown, the second firing direction 116*b* can be substantially incident to the second speaker driver 104*b*.

Additionally, the first and second firing directions 116*a*/116*b* can intersect at an intersection point 116*c*. In this regard, the first and second firing directions 116*a*/116*b* can be associated with an intersection angle 116*d*. In the foregoing manner, the speaker drivers of the speaker driver array 104 can be angularly arranged/positioned such that one speaker driver can be considered to be angularly displaced with respect to another speaker driver. The extent of angular displacement can correspond to the intersection angle 116*d*.

In one embodiment, the first and second speaker drivers 104*a*/104*b* can be arranged/positioned such that the intersection angle 116*d* is an angle between 15 degrees and 180 degrees. In this regard, it is appreciable that the first and second speaker drivers 104*a*/104*b* can be in a positioned in a fixed arrangement such that the intersection angle is fixed at an angle between 15 degrees and 180 degrees.

In another embodiment, the first and second speaker drivers 104*a*/104*b* can be arranged/positioned such that the intersection angle 116*d* can be varied. Particularly, the intersection angle 116*d* can be varied between 15 degrees and 180 degrees. In this regard, it is appreciable that the first and second speaker drivers 104*a*/104*b* can be positioned in a variable arrangement such that the intersection angle can be varied, as desired.

The variable arrangement can, for example, be in the manner of a swivel arrangement. For example, the top portion 102*a* can include a plurality of rotatable or swivel sections (not shown) such that each of the speaker drivers of the speaker driver array 104 can be carried by a rotatable or swivel section.

For example, the first speaker driver 104*a* can be carried by a first rotatable or swivel section and the second speaker driver 104*b* can be carried by a second rotatable or swivel section. Appreciably, by rotating or swiveling one or both of the first and second rotating sections, the first and second firing directions 116*a*/116*b*, of the first and second speaker drivers 104*a*/104*b* respectively, can be varied. In this manner, the first and second speaker drivers 104*a*/104*b* can rotate/swivel relative to each other, thus varying the intersection angle 116*d*.

Moreover, as shown in FIG. 1*a* and FIG. 1*b*, the speaker apparatus 100 can be in the form of a tower. In this regard, the speaker apparatus 100 can be a tower speaker. Additionally, the housing 102 can be substantially hexagonal in shape. It is appreciable that other shapes such as basic geometric shapes or geometric primitives can also be useful.

Earlier mentioned, the speaker apparatus 100 can be coupled to a first device which is operable to communicate audio signals to the speaker apparatus 100 for processing. Also earlier mentioned, audio inputs detected by the sound detection array 106 can be processed by the speaker apparatus 100.

More specifically, communicated audio signals and detected audio inputs can be processed by the processing module 108 in a manner as will be discussed in further detail hereinafter with reference to FIG. 2.

As shown, the speaker driver array 104, the sound detection array 106 and the coupling module 110 can be coupled to the processing module 108. The processing module 108 can be further coupled to the peripheral portion 112.

The processing module 108 can include an audio processing portion 120 and a detection processing portion 122. The processing module 108 can further include a detection control portion 124. The detection processing portion 122 can include a first processing segment 122*a* and a second processing segment 122*b*.

The audio processing portion 120 can be coupled to the coupling module 110 and the speaker driver array 104.

The detection processing portion 122 can be coupled to the sound detection array 106. Furthermore, the detection processing portion 122 can be further coupled to one or both of the coupling module 110 and the audio processing portion 120. The detection processing portion 122 can optionally be coupled (not shown) to the speaker driver array 104.

The detection control portion 124 can be coupled to the sound detection array 106. The detection control portion 124 can optionally be further coupled (not shown) to any of the coupling module 110, the audio processing portion 120 and the detection processing portion 122, or any combination thereof.

The audio processing portion 120 can be configured to process the audio signals in a manner so as to produce output signals as will be discussed hereinafter.

The output signals produced can include a plurality of sets of output signals corresponding to the plurality of speaker drivers of the speaker driver array 104. Preferably, the number of sets of output signals corresponds to the number of speaker drivers in the speaker driver array 104. For example, where the speaker driver array 104 includes the first and second speaker drivers 104*a*/104*b*, the output signals produced can correspondingly include a first set of output signals and a second set of output signals.

In one embodiment, the audio processing portion 120 can process the audio signals in a manner so as to amplify them. In this regard, the output signals communicated from the processing module 108 can correspond to amplified audio signals.

As mentioned earlier, audio signals communicated from the first device can, for example, include left channel audio signals and right channel audio signals. In this regard, the first set and second set of output signals can, for example, correspond respectively to amplified left channel audio signals and amplified right channel audio signals.

In another embodiment, the audio processing portion 120 can process the audio signals in a manner so as to amplify them as well as to adjust the balance between frequency components within the audio signals. In this regard, the output signals communicated from the processing module 108 can correspond to amplified audio signals which are also frequency processed.

As mentioned earlier, audio signals communicated from the first device can, for example, include left channel audio signals and right channel audio signals. In this regard, the first set and second set of output signals can, for example, correspond respectively to amplified left channel audio signals which are frequency processed and amplified right channel audio signals which are frequency processed.

The output signals can be communicated to the speaker driver array 104. The speaker driver array 104 can be configured to output the output signals. For example, the first set of output signals can be output by the first speaker driver 104*a* and the second set of output signals can be output by the second speaker driver 104*b*.

The detection processing portion 122 can be configured to process detected audio inputs in a manner so as to produce intermediate signals as will be discussed hereinafter.

Detected audio inputs can be processed by one or both of the first processing segment 122*a* and the second processing segment 122*b*. The first processing segment 122*a* can correspond to an Acoustic Echo Cancellation (AEC) module and the second processing segment 122*b* can correspond to a noise reduction module.

The first processing segment 122*a* can be configured to process the detected audio inputs in a manner so as to substantially eliminate unwanted feedback signals. Feedback signals can correspond to echoes of audio inputs. In this regard, the first processing segment 122*a* can, using conventional AEC techniques, eliminate unwanted feedback signals.

The second processing segment 122*b* can be configured to process the detected audio inputs in a manner so as to reduce spurious signals which can accompany the audio inputs. Spurious signals can, for example, be noise signals such as hissing noise signals, fan noise signals and vacuum noise signals. In this regard, the second processing segment 122*b* can, using conventional noise reduction techniques such as noise filtering techniques, reduce spurious signals accompanying the audio inputs.

Therefore, the intermediate signals can be based on audio inputs processed using one or both of AEC techniques and noise reduction techniques.

In one embodiment, the intermediate signals can be communicated from the coupling module 110 to, for example, the first device.

In another embodiment, the intermediate signals can be communicated to the audio processing portion 120 for further processing to produce processed intermediate signals. In this regard, the foregoing discussion to the processing of audio signals by the audio processing portion 120 analogously applies. The processed intermediate signals can be further communicated to one or both of the speaker driver array 104 for output and the coupling module 110 for further communication to, for example, the first device.

In yet another embodiment, the intermediate signals can be communicated to the speaker driver array 104 for output.

The detection control portion 124 can be configured to control the sound detection array 106 in a manner as will be discussed in further detail hereinafter.

Particularly, the detection control portion 124 can be configured to control the sound detection array 106 in a manner so as to detect audio inputs within a region adjacent thereto. More particularly the combination of the detection control portion 124 and the sound detection array 106 can, using conventional beamforming techniques, detect audio inputs within a region. Audio inputs outside the region can be ignored. The region can be a wedge shaped region. In this regard, the detection control portion 124 can correspond to a beamforming module.

Additionally, control signals can be communicated from the detection control portion 124 to the sound detection array 106 so as to control the sound detection array 106.

In one embodiment, the detection control portion 124 can be associated with default settings or predetermined settings such that control signals can be generated and communicated from the detection control portion 124.

In another embodiment, the control signals can be based on input signals received by the detection control portion 124. In one example, the input signals can be generated by one or both of the audio processing portion 120 and the detection processing portion 122. In another example, the input signals can be communicated via the coupling module 110 to the detection control portion 124.

Appreciably, the speaker apparatus 100 can be powered by the first device to which it is coupled. Earlier mentioned, the speaker apparatus 100 can be coupled to the first device via one or both of wired coupling and wireless coupling. Hence the speaker apparatus 100 can be powered via, for example, a USB connection and/or using wireless power/energy transfer techniques.

In one exemplary scenario, when coupled to the first device via a USB connection, current can be supplied from the first device to power the speaker apparatus 100. Specifically, any of the speaker driver array 104, the sound detection array 106, the processing module 108, the coupling module 110 and the peripheral portion 112, or any combination thereof can be powered by current supplied from the first device. Appreciably, current supplied via a USB connection may be limited. Limited current may give rise to limited power which may in turn adversely affect sound output performance of the speaker driver array 104.

Further appreciably, based on the abovementioned exemplary scenario, by configuring the audio processing portion 120 to process the audio signals in a manner so as to amplify them, as discussed earlier, sound output performance of the speaker driver array 104 may advantageously be substantially unaffected by limited power. In this regard, external power sources for powering the speaker apparatus 100 can be omitted.

Earlier mentioned, the speaker apparatus 100 can be coupled to a first device which is operable to communicate audio signals to the speaker apparatus 100 for processing. Coupling of the speaker apparatus 100 to a first device will be discussed in further detail hereinafter.

Figure 3:
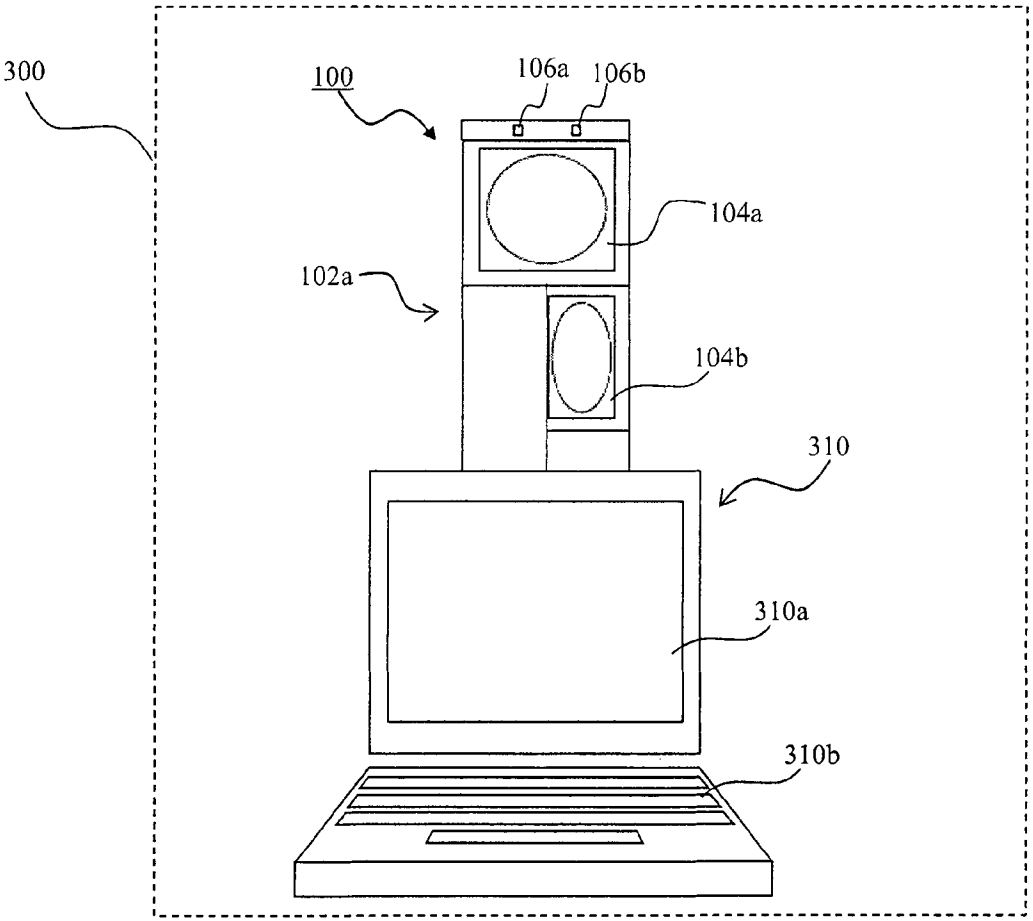
FIG. 3 illustrates an exemplary application where the speaker apparatus of FIG. 1*a* can be coupled to a device such as a computer, in accordance with an embodiment of the disclosure.

Referring to FIG. 3, in one exemplary application 300, the first device can be an electronic device such as a computer 310. The computer 310 can, for example, be a desktop type computer such as a workstation or a portable type computer such as a laptop.

The computer 310 can include a display portion 310*a* and an input portion 310*b*. The display portion 310*a* can, for example, be a display screen. The input portion 310*b* can, for example, be a keyboard. The computer 310 can further include a communication portion (not shown) having an input/output (I/O) port and/or a transceiver module suitable for one or both of wired communication and wireless communication. The I/O port can, for example, be a USB port.

The computer 310 can be coupled to the speaker apparatus 100. Specifically, the communication portion of the computer 310 can be coupled to the coupling module 110 of the speaker apparatus 100. More specifically, the communication portion of the computer 310 can be coupled to the coupling module 110 of the speaker apparatus 100 via one or both of wired coupling and wireless coupling.

Preferably, the computer 310 can be used by a user (not shown) for data input using the input portion 310*b*. The data input can be processed by the computer 310 to produce display data which can be displayed via the display portion 310*a* for viewing by the user.

Additionally, via the input portion 310*b*, the user can generate the aforementioned input signals, which can be communicated to the detection control portion 124 for generating control signals for controlling the sound detection array 106. Furthermore, the sound detection array 106 can be configured in a manner, as discussed earlier with reference to FIG. 2, to detect audio inputs such as voice inputs from the user.

Moreover, the computer 310 can be configured to power the speaker, apparatus 100. For example, the communication portion can include a USB based I/O port through which current for powering the speaker apparatus 100 can be communicated. Specifically, current for powering the speaker apparatus 100 can be received via the coupling module 110.

Furthermore, the computer 310 can be configured to communicate audio signals to the speaker apparatus 100. The audio signals can, for example, be stereo based audio signals. In this regard, the audio signals can include left channel audio signals and right channel audio signals. The left channel audio signals and the right channel audio signals can be audio signals which can suitably be audibly perceived by the left ear and right ear, respectively, of the user of the computer 310.

As the coupling module 110 of the speaker apparatus 100 can be coupled to the communication portion of the computer 310 via one or both of wired coupling and wireless coupling, the left and right channel audio signals can, for example, be communicated from the communication portion of the computer 310 to the coupling module 110 of the speaker apparatus 100.

The left and right channel audio signals received via the coupling module 110 can be communicated to the processing module 108 for processing to produce output signals. The output signals can be communicated to the speaker driver array 104 for output such that the output signals can be audibly perceived by the user.

The output signals produced can include the aforementioned first set of output signals and the aforementioned second set of output signals. The first set and second set of output signals can be output by the first and second speaker drivers 104*a*/104*b* respectively.

In one embodiment, the first set and second set of output signals can be based on the left and right channel audio signals respectively. In this regard, the first speaker driver 104*a* can correspond to a left channel speaker and the second speaker driver 104*b* can correspond to a right channel speaker.

In another embodiment, the first set and second set of output signals can be based on the right and left channel audio signals respectively. In this regard, the first speaker driver 104*a* can correspond to a right channel speaker and the second speaker driver 104*b* can correspond to a left channel speaker.

As shown, the speaker apparatus 100 can be positioned behind the computer 310. When positioned behind the computer 310, the body portion 102*b* of the speaker apparatus 100 can be substantially hidden by the computer 310.

Specifically, the body portion 102*b* can be substantially hidden by the screen 310*a* of the computer 310 such that the body portion 102*b* can substantially be blocked from the view of the user facing the screen 310*a* of the computer 310. Additionally, the top portion 102*a* of the speaker apparatus 100 can be substantially elevated over the screen 310*a* of the computer 310. Specifically, view of the top portion 102*a*, by the user facing the screen 310*a*, can be substantially unimpeded.

Additionally, the speaker apparatus 100 can be configured in a manner such that extent of elevation of the top portion 102*a* of the speaker apparatus 100 over the screen 310*a* of the computer 310 can be varied.

For example, the body portion 102*b* of the speaker apparatus 100 can include a plurality of telescoping sections (not shown) such that the body portion 102*b* can be variably extended or shortened. In this manner, extent of elevation of the top portion 102*a* of the speaker apparatus 100 over the screen 310*a* of the computer 310 can be varied.

Furthermore, earlier mentioned, the housing 102 can be detachably coupled to the base portion 103. Appreciably, the base portion 103 can further afford flexibility in varying extent of elevation of the top portion 102*a* of the speaker apparatus 100 over the screen 310*a* of the computer 310.

In this manner output signals can be output by the speaker driver array 104 without being significantly impeded by the screen 310*a* of the computer 310. Thus audio enjoyment of the user who is facing the screen 310*a* will not be detracted since output signals are not significantly muffled by the screen 310*a*.

Earlier mentioned, the speaker driver array 104 can be accommodated at the top portion 102*a*. Additionally, the speaker driver array 104 can include a plurality of speaker drivers. For example, the speaker driver array 104 can include the aforementioned first and second speaker drivers 104*a*/104*b*. Further earlier mentioned, the first and second speaker can be associated with a first firing direction 116*a* and a second firing direction 116*b* respectively.

In one embodiment, when positioned behind the computer 310 which is used by a user who is facing the screen 310*a* of the computer 310, the speaker apparatus 100 can be further positioned such that the first firing direction 116*a* is substantially on-axis relative to the user and the second firing direction 116*b* is substantially off-axis relative to the user.

In another embodiment, when positioned behind the computer 310 which is used by a user who is facing the screen 310*a* of the computer 310, the speaker apparatus 100 can be further positioned such that the second firing direction 116*b* is substantially on-axis relative to the user and the first firing direction 116*a* is substantially off-axis relative to the user.

In yet another embodiment, when positioned behind the computer 310 which is used by a user who is facing the screen 310*a* of the computer 310, the speaker apparatus 100 can be further positioned such that both the first and second firing directions 116*a*/116*b* are substantially off-axis relative to the user.

Appreciably, as the first and second speaker drivers 104*a*/104*b* of the speaker driver array 104 face different directions, stereo effect associated with the output signals can still be capable of being audibly perceived by the user although the first and second speaker drivers 104*a*/104*b* are arranged in a stacked arrangement where, for example, the first speaker driver 104*a* is atop the second speaker driver 104*b*.

In this manner, the user can be afforded compact arrangement with regard to positioning of the speaker drivers without substantially compromising the stereo effect of the output signals from the speaker drivers.

Additionally, as mentioned earlier, the first and second speaker drivers 104*a*/104*b* can, in one embodiment be positioned in a variable arrangement. In this regard, the first and second speaker drivers 104*a*/104*b* can be flexibly positioned such that extent of angular displacement can be varied. Thus flexibility in adjustment can be afforded to the user for enhancing stereo effect of the output signals.

Moreover, further mentioned earlier, the housing 102 can be coupled to the base portion 103 such that housing 102 is rotatable on the base portion 103. Thus flexibility in adjustment can be further afforded to the user for enhancing stereo effect of the output signals.

It is further appreciable that with the speaker apparatus 100, the user can be afforded the advantage of minimizing the use of cables or wired connections since the speaker array 104 is carried by the housing 102 and coupling of the speaker apparatus 100 to the computer can be one or both of wired coupling or wireless coupling. Wired coupling can, for example, be in the form of a USB connection.

In the foregoing manner, various embodiments of the disclosure are described for addressing at least one of the foregoing disadvantages. Such embodiments are intended to be encompassed by the following claims, and are not to be limited to specific forms or arrangements of parts so described and it will be apparent to one skilled in the art in view of this disclosure that numerous changes and/or modification can be made, which are also intended to be encompassed by the following claims.

The invention claimed is:

1. A speaker apparatus suitable for use with a computer operable for communicating audio signals to the speaker apparatus, the speaker apparatus comprising:

a housing having a top portion and a body portion, the top portion being adjacent to the body portion, the housing configurable for carrying:

a coupling module for coupling the speaker apparatus and the computer; and a speaker driver array comprising a first speaker driver and a second speaker driver, the first and second speaker drivers being arranged in a stacked arrangement such that the first speaker driver is positionable atop the second speaker driver and such that the first and second speaker drivers face different directions, wherein the speaker apparatus is positionable behind the computer in a manner such that the body portion of the housing is substantially hidden by the computer and the top portion of the housing is substantially elevated over the computer, wherein the speaker driver array is accommodatable at the top portion of the housing, and wherein in the stacked arrangement, the first speaker driver and the second speaker driver are angularly displaced in a manner such that they face different directions, and wherein the first speaker driver is associable with a first firing direction substantially incident thereto and the second speaker driver is associable with a second firing direction substantially incident thereto, the first firing direction and the second firing direction being associable with an intersection angle corresponding to extent of angular displacement.

2. The speaker apparatus as in claim 1, wherein the housing is further configurable for carrying a processing module which is coupled to the coupling module and the speaker driver array, and wherein audio signals from the computer are communicable to the processing module for processing to produce output signals, the output signals being communicable to the speaker driver array for output.

3. The speaker apparatus as in claim 2, wherein the output signals comprise a first set of output signals and a second set of output signals, the first and second set of output signals being output by the first speaker driver and the second speaker driver respectively.

4. The speaker apparatus as in claim 3, wherein in the stacked arrangement, the first speaker driver and the second speaker driver are angularly displaced in a manner such that they face different directions, wherein the first speaker driver is associable with a first firing direction substantially incident thereto and the second speaker driver is associable with a second firing direction substantially incident thereto, and wherein the first and second firing directions are indicative of general direction of emission, from the first and second speaker drivers respectively, of the first set of output signals and the second set of output signals respectively.

5. The speaker apparatus as in claim 4, emission of the first and second set of output signals from the first and second speaker drivers respectively being substantially unimpeded by the computer.

6. The speaker apparatus as in claim 2, wherein the processing module is configurable for processing the audio signals in a manner so as to amplify them, and wherein the output signals correspond to amplified audio signals.

7. The speaker apparatus as in claim 2, wherein the housing is further configurable for carrying a sound detection array which is coupled to the processing module, the sound detection array being configurable for detecting audio inputs within a region adjacent thereto.

8. The speaker apparatus as in claim 7, wherein the processing module is configurable for processing detected audio inputs to produce intermediate signals communicable to at least one of the coupling module and the speaker driver array, and wherein the processing module is configurable for processing detected audio inputs using at least one of Acoustic Echo Cancellation techniques and noise filtering techniques to produce the intermediate signals.

9. The speaker apparatus as in claim 2, wherein the housing is further configurable for carrying a peripheral portion which is coupled to the processing module, the peripheral portion being configurable for receiving a peripheral device capable of facilitating signal communication between an auxiliary device and the speaker apparatus.

10. The speaker apparatus as in claim 1, wherein the body portion is variably adjustable in a manner so as to one of variably extend and shorten the body portion such that extent of elevation of the top portion over the computer is variable.

11. The speaker apparatus as in claim 1 further comprising:

a base portion to which the housing is detachably coupled, wherein the housing is rotatable on the base portion.

12. The speaker apparatus as in claim 1, wherein the top portion comprises a first rotatable section and a second rotatable section, wherein the first speaker driver is accommodatable in the first rotatable section and the second speaker driver is accommodatable in the second rotatable section, and wherein the first and second speaker drivers are capable of being swiveled relative to each other.

13. A speaker apparatus suitable for use with a computer having a screen and which is operable for communicating audio signals to the speaker apparatus, the speaker apparatus comprising:

a housing having a top portion and a body portion, the top portion being adjacent to the body portion, the housing configurable to carry:

a coupling module for coupling the speaker apparatus and the computer in a manner such that audio signals are communicable from the computer to the speaker apparatus for processing;

a processing module coupled to the coupling module in a manner so as to receive the audio signals, audio signals being processable by the processing module in a manner so as to produce output signals; and a speaker driver array coupled to the processing module in a manner so as to receive the output signals, the output signals capable of being output by the speaker driver array, the speaker driver array comprising a first speaker driver and a second speaker driver, the first and second speaker drivers being arranged in a stacked arrangement such that the first speaker driver is positionable atop the second speaker driver and such that the first and second speaker drivers face different directions, the speaker driver array being accommodatable at the top portion of the housing, wherein the speaker apparatus is positionable behind the computer in a manner such that the body portion of the housing is substantially hidden by the screen of the computer and the top portion of the housing is substantially elevated over the screen of the computer.

* * * * *